US009074753B1

(12) United States Patent
Al-Asfour

(10) Patent No.: US 9,074,753 B1
(45) Date of Patent: Jul. 7, 2015

(54) LIGHTING POLES WITH ACCESSIBLE ELECTRICS

(71) Applicant: Faisal A Al-Asfour, AlShoeb (KW)

(72) Inventor: Faisal A Al-Asfour, AlShoeb (KW)

( * ) Notice: Subject to any disclaimer, the term of this patent is extended or adjusted under 35 U.S.C. 154(b) by 0 days.

(21) Appl. No.: 14/644,378

(22) Filed: Mar. 11, 2015

Related U.S. Application Data

(63) Continuation-in-part of application No. 14/023,634, filed on Sep. 11, 2013.

(51) Int. Cl.

| | |
|---|---|
| ***F21S 8/00*** | (2006.01) |
| ***F21S 13/10*** | (2006.01) |
| ***F21V 14/02*** | (2006.01) |
| ***F21S 8/08*** | (2006.01) |
| ***F21V 21/26*** | (2006.01) |
| *F21W 131/103* | (2006.01) |

(52) U.S. Cl.
CPC ..... *F21V 14/02* (2013.01); *F21S 8/086* (2013.01); *F21V 21/26* (2013.01); *F21W 2131/103* (2013.01)

(58) Field of Classification Search
CPC ..... F21V 14/02; F21V 21/26; F21S 8/086; F21W 2131/103
USPC ..... 362/233, 249.07, 403, 418, 431
See application file for complete search history.

(56) References Cited

U.S. PATENT DOCUMENTS

| | | | |
|---|---|---|---|
| 3,805,054 | A | 4/1974 | Wolf |
| 4,092,707 | A | 5/1978 | Millerbernd |
| 4,348,717 | A | 9/1982 | Thompson |
| 4,600,348 | A | 7/1986 | Pettit |
| 7,770,324 | B2 | 8/2010 | Hogan |

*Primary Examiner* — Jason Moon Han
(74) *Attorney, Agent, or Firm* — Lowe Hauptman & Ham LLP

(57) ABSTRACT

The present invention provides an adjustable street light having a pole having a first end and a second end, an anchor member, wherein the second end of the pole is attached to the anchor member. A sleeve member slidably mounted on said pole, a pair of opposing arms pivotally attached to the sleeve member, and a pair of light housings each attached to an end of the pair of opposing arms. The adjustable street light also includes a gear mechanism for rotating the sleeve member, and a gear mechanism for raising the sleeve member up and down along the pole.

6 Claims, 6 Drawing Sheets

LIGHTING POLES WITH ACCESSIBLE ELECTRICS

CROSS REFERENCE TO RELATED APPLICATIONS

The present application is a Continuation-In-Part of U.S. patent application Ser. No. 14/023,634, filed on Sep. 11, 2013, and priority is hereby claimed under 35 U.S.C. §120 based on this application and is hereby incorporated by reference in its entirety into the present application.

TECHNICAL FIELD

The present invention is generally directed toward street or highway overhead lighting, and more particularly, to an adjustable and rotatable street or highway overhead light.

BACKGROUND OF THE INVENTION

Many prior street overhead lighting devices have been developed in recent years. Although some are adjustable in height, these street overhead lighting devices cannot be adjusted in height with a simple mechanism, and cannot be rotated to illuminate the desired side of the road or highway.

Considering that the high-mast poles of most street or highway overhead lights can reach up to 120 feet in height, the routine and regular maintenance, such as replacing or cleaning the lights, requires tremendous efforts using bucket trucks to get access to the lights at that height, and further requires closing the street or highway resulting in unnecessary traffic.

For example, U.S. Pat. No. 4,092,707, issued to Millerbernd, discloses a light supporting frame and carriage mounted for vertical movement on a hollow tower. A hoisting motor with cable and pulleys are provided to raise and lower the light member.

Another approach is disclosed in U.S. Pat. No. 4,348,717, issued to Thompson, in which a support ring with centering means as it is raised and lowered on a pole 1, and further including a cable on a cable sheave.

One of the disadvantages associated with these prior art adjustable street or highway overhead lights is that their mechanisms do not allow for an easy adjustment of height. Yet another disadvantage with these prior art street or highway overhead lights is that they do not provide for a mechanism to be able to rotate the lighting device.

It is therefore a primary object of the present invention to provide a street or highway overhead light and mechanism that allows for an easy adjustment of height thereof, and further allows for the rotation of the light to a desired degree of rotation.

Notwithstanding the above, it is presently believed that there may be a significant demand in the marketplace for a street or highway overhead light having an adjustable mechanism with the above-stated features of the present invention.

BRIEF SUMMARY OF THE INVENTION

These problems and others are addressed by the present invention which comprises an adjustable street light having a pole having a first end and a second end, an anchor member, wherein the second end of the pole is attached to the anchor member. A sleeve member slidably mounted on said pole, a pair of opposing arms pivotally attached to the sleeve member, and a pair of light housings each attached to an end of the pair of opposing arms. The adjustable street light also includes a gear mechanism for rotating the sleeve member, and a gear mechanism for raising the sleeve member up and down along the pole.

BRIEF DESCRIPTION OF THE DRAWINGS

These and other objects of the present invention will be appreciated and understood by those skilled in the art from the detailed description of the preferred embodiments of the invention and the following drawings of which.

DETAILED DESCRIPTION OF THE INVENTION

Figure 1:
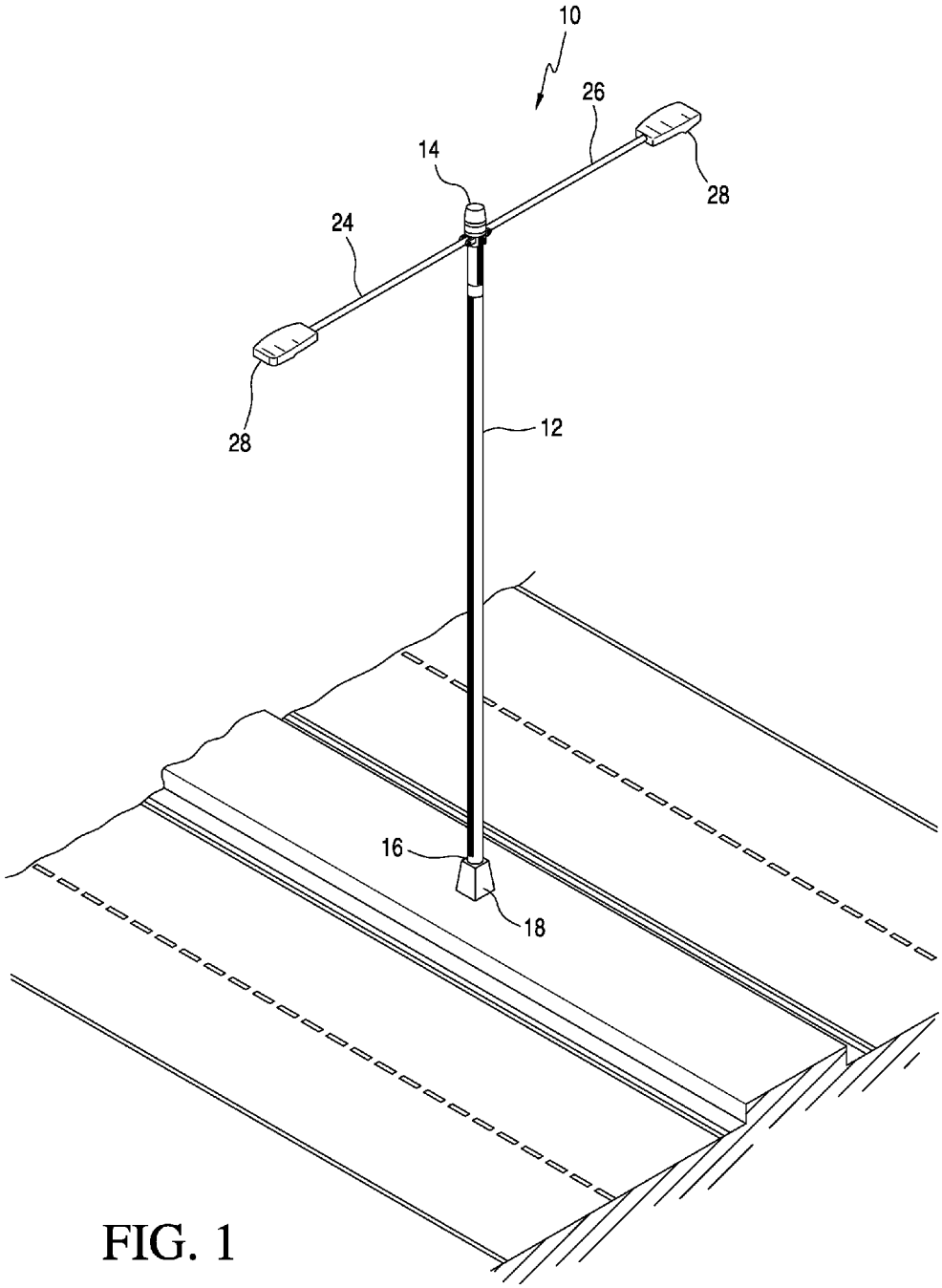
FIG. 1 is a perspective view of an adjustable street or highway overhead light in a raised configuration in accordance with a preferred embodiment of the present invention.
Figure 2:
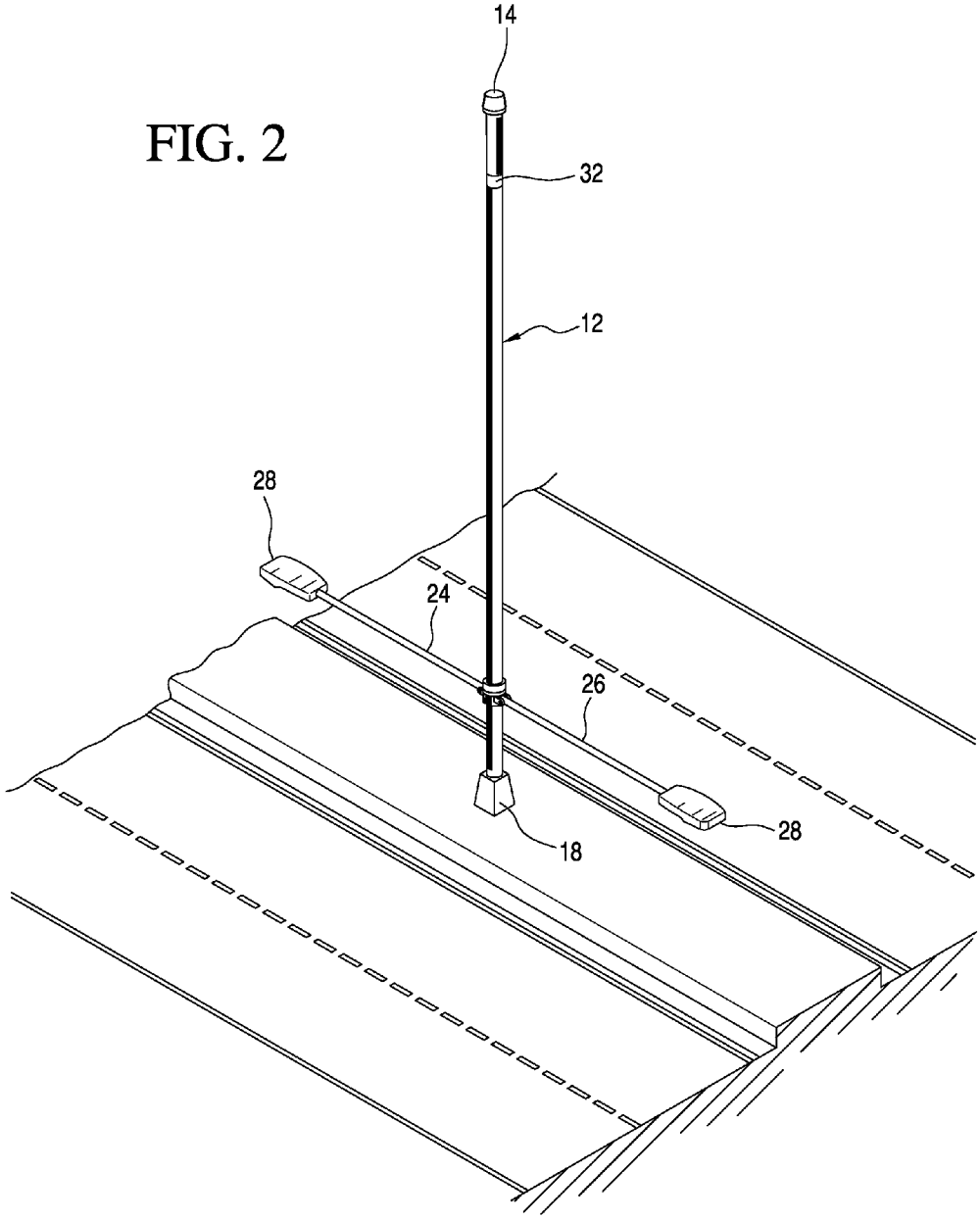
FIG. 2 is a perspective view of the street or highway overhead light shown in FIG. 1 in a lowered and rotated position.
Figure 3:
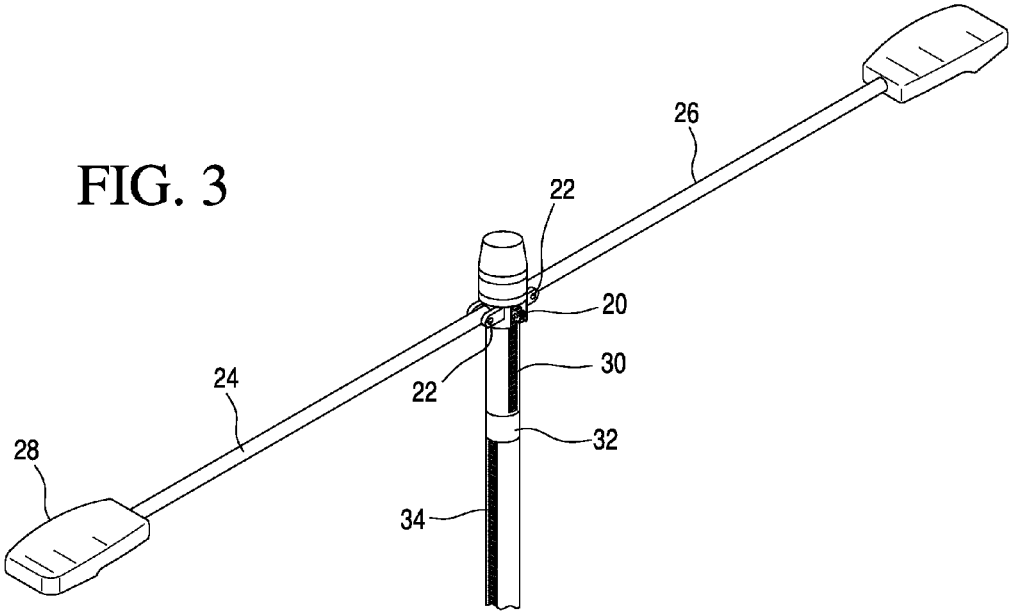
FIG. 3 is a perspective view of the street or highway overhead light shown in FIG. 1 in a raised position.
Figure 4:
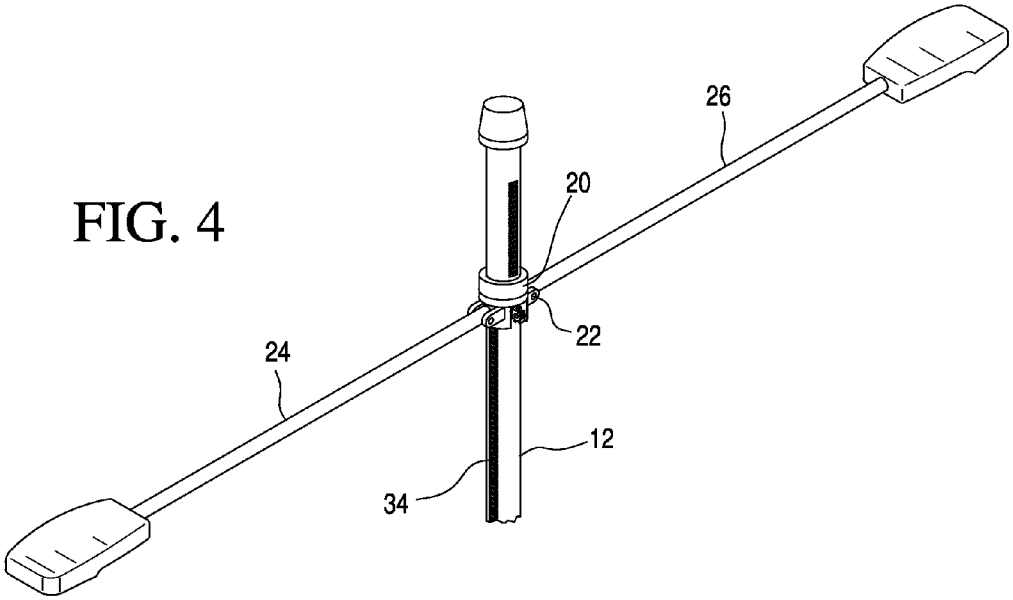
FIG. 4 is a perspective view of the street or highway overhead light shown in FIG. 1 in a first lowered position.
Figure 5:
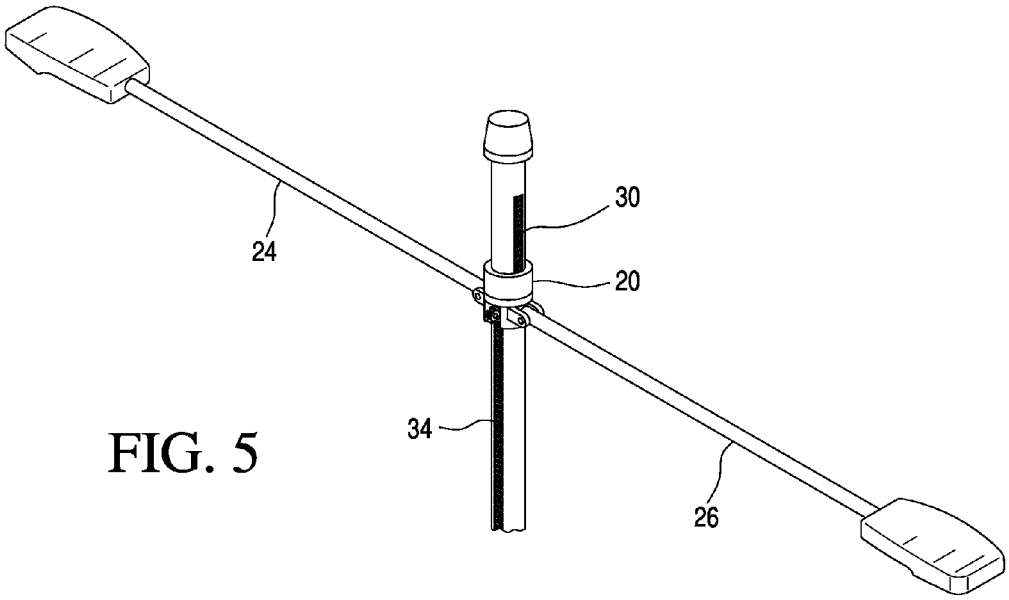
FIG. 5 is a perspective view of the street or highway overhead light shown in FIG. 4 in a first lowered position but rotated at a 90 degree angle.

For the purpose of promoting and understanding of the principles of the invention, reference will now be made to the embodiments illustrated in the drawings. Referring now to the drawings, and more specifically to FIGS. 1 to 6, wherein the showings are for the purpose of illustrating the preferred embodiment of the invention only and not for the purpose of limiting the same, a highway overhead light is generally illustrated at 10 and includes a pole 12 having a first end 14 and second 16. The pole is generally made of material such as, but not limited to, aluminum or steel, and preferably has a cylindrical shape and configuration. However, other shapes and configurations such a square is contemplated to be within the scope of the present invention.

The second end 16 of the pole 12 is secured and embedded into the ground using an anchor base 18 or any other attachment means that can secure the second end 16 of the pole into a foundation in order to keep the pole fixed into the ground in an upright position.

The highway overhead light 10 includes a first arm 24 and an opposing second arm 26. Each arm 24, 26 includes a light housing 28 secured at the opposing ends of each first and second arms 24, 26. The light housing 28 supports and houses a light source such as incandescent light bulbs or high intensity discharge lamps.

A sleeve member 20 is adapted to slidably fit over the pole 12 and includes a pair of opposing securing members 22 each adapted having the ends of first and second arms 24, 26 to pivotally attached thereto. As will be explained in greater detail herein, the pivoting attachment allows for the first and second arms 24, 26 to pivot in a vertical direction to the extent that allows each of the first and second arms 24, 26 become aligned and parallel with the pole 12.

Figure 6:
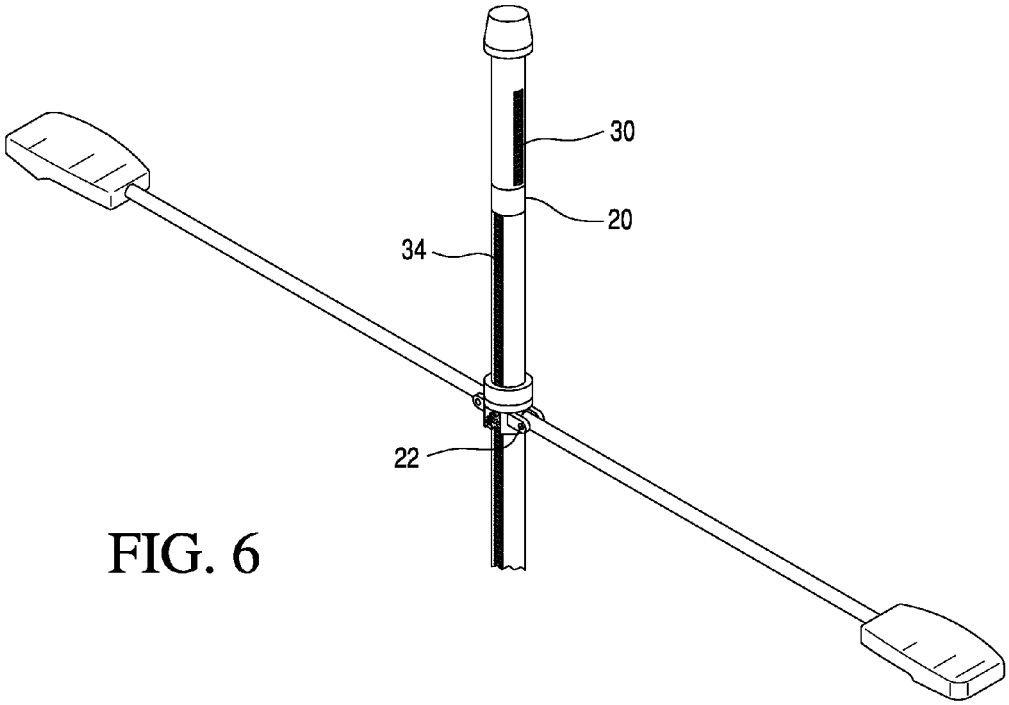
FIG. 6 is a perspective view of the street or highway overhead light shown in FIG. 5 in a second lowered position still at a 90 degree angle.
Figure 7:
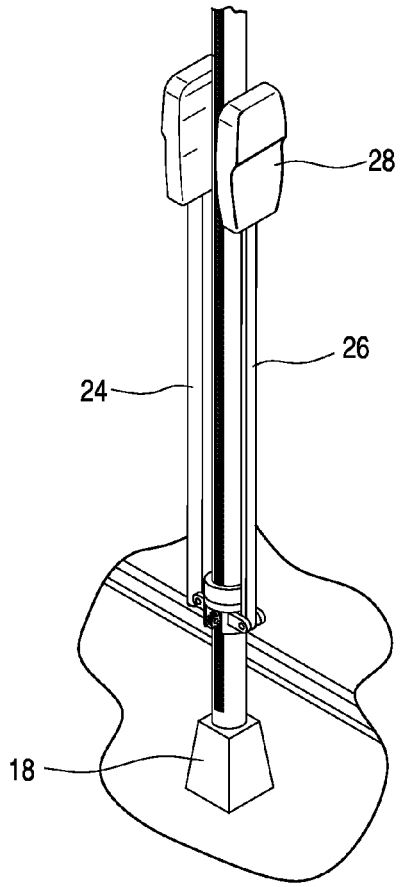
FIG. 7 is a perspective view of the street or highway overhead light shown in FIG. 6 with the arms in folded configuration.

Referring now to FIG. 6, the pole includes a first pair of opposing rack teeth 30 disposed on an outer surface of the pole 10 and extending from a point proximate to the first end 14 of the pole 12 and terminating at smooth portion 32 on the outer surface of the pole 12. A pair of second opposing rack teeth 34 oriented at 90 degrees relative to the first pair of opposing rack teeth 30 is positioned below the smooth portion of the pole 12 and extends down along the outer surface of the pole 12 to a position proximate the anchor base 18.

Figure 8:
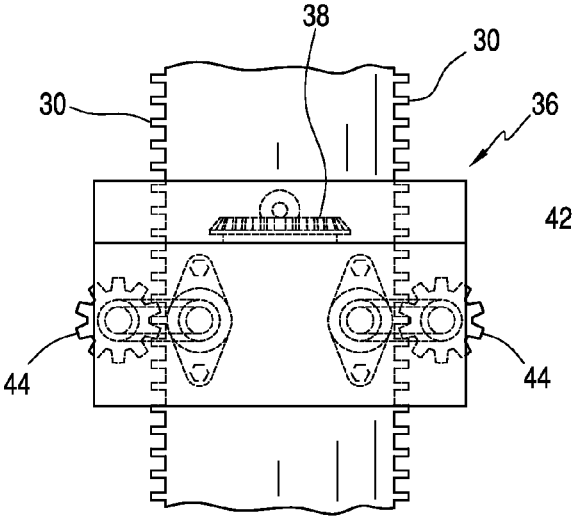
FIG. 8 is a front sectional view of the gear mechanism for the adjustable apparatus of the street or highway overhead light in accordance with the embodiment shown in FIG. 1.
Figure 9:
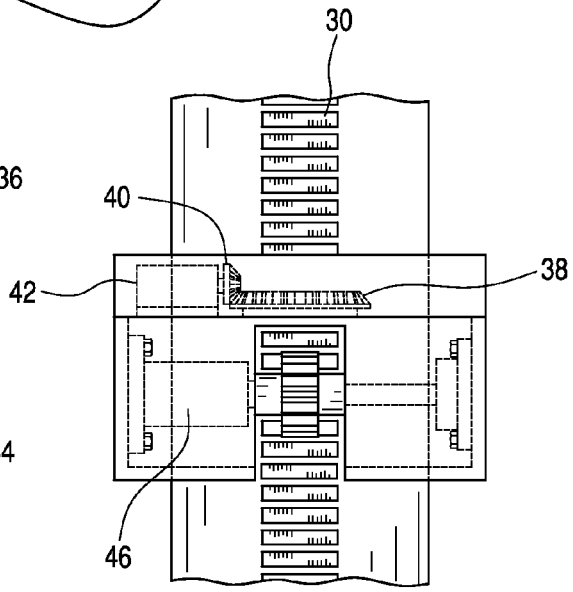
FIG. 9 is a rear sectional view of the gear mechanism for the adjustable apparatus of the street or highway overhead light in accordance with the embodiment shown in FIG. 1.

Referring to FIGS. 8 and 9, the raising and lowering mechanism of the sleeve member 20 is generally illustrated at 36. A pinion gear 38 is attached to the sleeve member 20 and engages with a second pinion gear 40 rotatable by a rotating mechanism such as an electric motor 42 which allows for the rotation of the sleeve member 20.

A pair of opposing gears 44 are also operably attached to the sleeve member 20 and are rotatable by a rotating mechanism such as, but not limited to, an electric motor 46. The gears 44 mesh with and engage the corresponding first or second pair of opposing rack teeth 30, 34, the rotation of which allow for the movement of the sleeve member 20 up and down, thereby raising the opposing arms 24, 26 and provide easy access to the light housings 28 for regular maintenance or cleaning.

In order to rotate the sleeve member 20 and thereby rotate the first and second arms 24, 26 by 90 degrees, the sleeve is lowered to a position over the smooth outer surface of the pole 12 in order to disengage from the gearing mechanism and be able to rotate freely.

Figure 11:
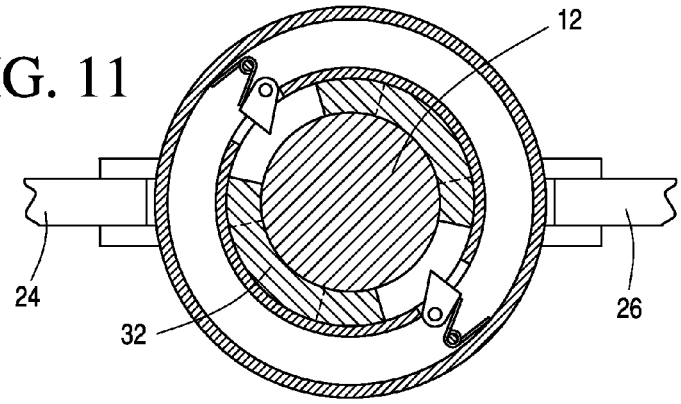
FIG. 11 is a top view of a rotatable and stop mechanism in accordance with the present invention.
Figure 10:
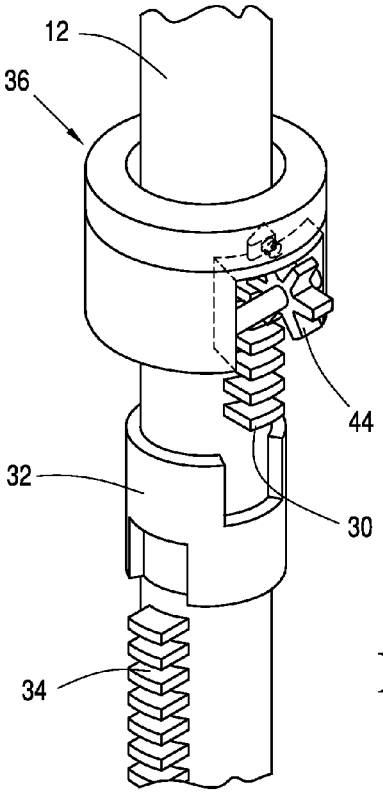
FIG. 10 is a perspective view of a light post or pole with a rotatable and stop mechanism in accordance with the present invention.
Figure 12:
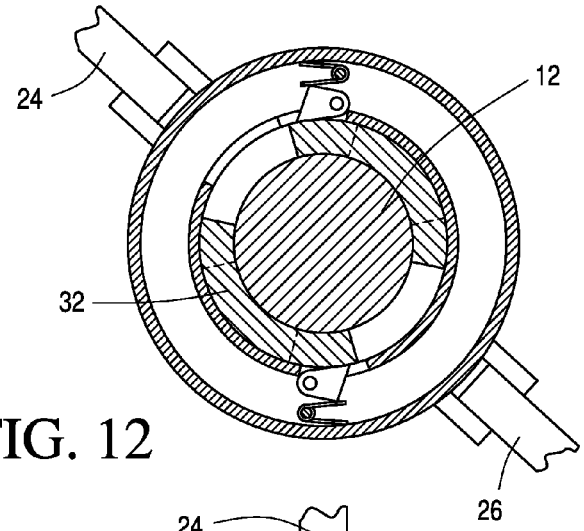
FIG. 12 is a rotatable and stop mechanism as shown in FIG. 11 but partially rotated.
Figure 13:
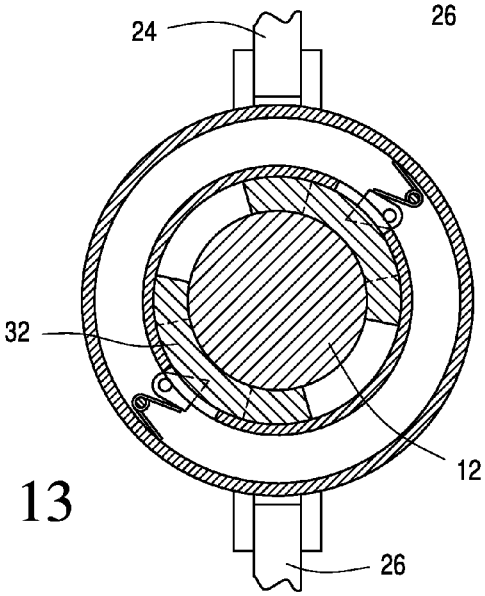
FIG. 13 is a rotatable and stop mechanism as shown in FIGS. 11 and 12 but rotated further.

As illustrated in FIGS. 10-13 a rotatable stop assembly 36 (FIG. 10) includes a fixed member 32 that is fixed to a post or pole 12 as shown in FIGS. 11-13. The rotatable stop assembly 36 includes an outer portion that is spaced outwardly from the pole 12 in order to pass over the stop or fixed member 32. The outer portion is prevented from passing over the fixed member 32 by the pinion gear 44 as long as the pinion gear 44 is aligned with the gear engaging teeth and by the fixed member 32 until the pinion gear 44 is aligned with one of the openings as for example when the gear 44 is aligned with a second opening i.e. for rack teeth 34. At that time the pinion 44 is rotated to move the assembly downwardly along the rack teeth 34.

While preferred embodiments of the invention have been shown and described, various modifications and substitutions may be made thereto without departing from the spirit and scope of the invention. Accordingly, it is to be understood that the present invention has been described by way of illustration only, and this description should not be construed as limiting to the several claims appended hereto.

What is claimed is:

1. An adjustable street light, comprising:

a pole having a first end and a second end;

an anchor member, wherein said second end of said pole is attached to said anchor member;

a sleeve member slidably mounted on said pole;

a pair of opposing arms pivotally attached to said sleeve member;

a pair of light housings each attached to an end of said End of said pair of opposing arms;

a fixed member that is fixed to said pole;

a rotatable and stop assembly having a first stop fixed to said pole and including two openings for engagement of a pinion with a first or a second rack on said fixed member and a pair of stops for preventing rotation about said fixed member by more than about 90°;

means for rotating said sleeve member; and, means for raising said sleeve member up and down along said pole.

2. The adjustable street light of claim 1, further comprising a first pair of opposing rack teeth on an outer surface of said pole.

3. The adjustable street light of claim 2, further comprising a smooth outer surface portion below said first pair of opposing rack teeth on said outer surface of said pole.

4. The adjustable street light of claim 3, further comprising a second pair of opposing rack teeth on said outer surface of said pole extending downwardly below said smooth portion.

5. The adjustable street light of claim 4, wherein said raising means comprises a pair of gears pivotally attached to said sleeve and engageable with either said first pair of opposing rack teeth said second opposing pair of rack teeth.

6. The adjustable street light of claim 1, wherein said rotating means further comprising a first bevel gear attached to said sleeve and a second bevel gear on said pole and rotatably engaged with said first bevel gear.

* * * * *